US007377724B2

(12) United States Patent
Öberg et al.

(10) Patent No.: US 7,377,724 B2
(45) Date of Patent: May 27, 2008

(54) METHOD AND DEVICE FOR INSTALLING A SELF-DRILLING EXPANDABLE ROCK BOLT AND A SELF-DRILLING ROCK BOLT

(75) Inventors: Fredrik Öberg, Örebro (SE); Morgan Kanflod, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 234 days.

(21) Appl. No.: 10/574,635

(22) PCT Filed: Oct. 20, 2004

(86) PCT No.: PCT/SE2004/001514

§ 371 (c)(1),
(2), (4) Date: Apr. 3, 2006

(87) PCT Pub. No.: WO2005/047649

PCT Pub. Date: May 26, 2005

(65) Prior Publication Data

US 2007/0122238 A1 May 31, 2007

(30) Foreign Application Priority Data

Nov. 13, 2003 (SE) ..... 0302997

(51) Int. Cl.
*E21D 20/00* (2006.01)

(52) U.S. Cl. ..... 405/259.3; 405/259.1; 405/259.5

(58) Field of Classification Search ..... 405/259.1, 405/259.3

See application file for complete search history.

(56) References Cited

U.S. PATENT DOCUMENTS 4,423,986 A 1/1984 Skogberg
7,080,697 B2 * 7/2006 Mocivnik ..... 405/259.3
7,270,501 B2 * 9/2007 Kanflod et al. ..... 405/259.3

(Continued)

FOREIGN PATENT DOCUMENTS

DE 4024869 2/1991

(Continued)

OTHER PUBLICATIONS

JP 2002-174100, Published Jun. 21, 2002.

*Primary Examiner*—Frederick L. Lagman
(74) *Attorney, Agent, or Firm*—Mark P. Stone

(57) ABSTRACT

In a method and a device for installing, in a rock wall or roof, a self-drilling expandable rock bolt (2) having a drill bit portion (5), an expansion portion (9) and a connecting portion (10), in a rock breaking step, the self-drilling rock bolt (2) is provided with a rock breaking movement and flushing fluid for producing a bore hole, and in an expansion step, pressurized expansion fluid is introduced into the expansion portion (9) in order to expand it so as to be fixed to the inside of the bore hole. Expansion fluid is introduced by means of a swiveling device (6) so that the rock bolt (2) is free to move during the rock breaking step, and be tightened against the rock bolt (2) in the expansion step in such a way that a sealed channel for expansion fluid is established between an expansion fluid source and the expansion portion (9). The invention also concerns a self-drilling rock bolt.

20 Claims, 3 Drawing Sheets

U.S. PATENT DOCUMENTS

2005/0084339 A1* 4/2005 Meisenbichler et al. . 405/259.3
2007/0081864 A1* 4/2007 Iwasaki et al. ..... 405/259.3
2007/0274788 A1* 11/2007 Ravat ..... 405/259.3

FOREIGN PATENT DOCUMENTS

WO WO 2005047651 A1 * 5/2005
WO WO 2005047652 A1 * 5/2005

* cited by examiner

METHOD AND DEVICE FOR INSTALLING A SELF-DRILLING EXPANDABLE ROCK BOLT AND A SELF-DRILLING ROCK BOLT

FIELD OF THE INVENTION

This invention concerns a method and a device for installing a self-drilling expandable rock bolt according to the respective preambles of claims 1 and 7 and a self-drilling expandable rock bolt according to the preamble of the claim 13.

DESCRIPTION OF PRIOR ART

Tube-formed expandable rock bolts are used in mines and tunnels in order to stabilize the rock face and/or to provide anchoring devices for use as supports for various equipment to be suspended at the rock face. Fixing of such a rock bolt inside a bore hole is accomplished by pressurizing a tubular body in-order to obtain a permanent fixation of the rock bolt against the bore hole surface.

Previous tubular expandable rock bolts of this kind are typically introduced into pre-drilled bore holes and subsequently pressurized.

In particularly in applications where a rock bolt is to be installed in unstable rock, it is observed that rock fragments from the bore hole surface tend to move inwards so as to obstruct insertion of the rock bolt into the hole.

JP patent application 2000-373505 (Kumaigai et al) describes a self-drilling expansion type rock bolt having a drill bit at the front end of the bolt itself. This measure makes it possible to avoid the necessity of pre-drilling a bolt hole for the rock bolt to be introduced into. The device according to this patent document, however, does not provide a practical solution to the problem of providing efficient means for efficiently carrying out the expansions step.

AIM AND MOST IMPORTANT FEATURES OF THE INVENTION

It is an aim of this invention to provide a method and device according to the above providing a solution to the problem of the prior art.

It is another aim of this invention to provide an expandable rock bolt according to the above that solves the problem of the prior art rock bolt.

These objects are obtained in a method and in a device according to the above through the features of the characterizing portions of the respective claims 1, 7 and 13.

This way it has been made possible to provide a far faster and more secure installation of rock bolt which radically reduces the installation costs for each rock bolt and altogether reduces cost of the entire tunneling and mining operation.

By providing a rock drilling machine, which may be any standard rock drilling machine, with a swiveling device it is possible to carry out the drilling step and subsequently expand the rock bolt without the need of retracting the rock drilling machine in order to connect a separate expansion fluid source.

This speeds up the installation process and provides a far more secure installation since the rock bolt does not have to be released from the rock drilling machine, which instead, also during the expansion step, can continue to be connected to the rock bolt, thereby avoiding the need for other external measures and devices for preventing the rock bolt from falling out from the drilled hole.

It is preferred that the swiveling device includes a pressure fluid effected sealing device in order to obtain the sealed channel in the expansion step. This solution makes it easy to safely control the sealing operation at a distance from the location of the rock bolt. In particular it is preferred and efficient that the seal is provided on two axial sides of a fluid inlet, since this makes the relative rotational position of the swiveling device and the rock bolt optional.

Using expansion fluid for tightening purposes is preferred because this makes additional fluid sources unnecessary.

Other advantages are obtained through other features of the invention which will be explained below.

BRIEF DESCRIPTION OF DRAWINGS

The invention will now be described at the back ground of an embodiment and with reference to the annexed drawings, wherein.

DESCRIPTION OF THE EMBODIMENT

Figure 1:
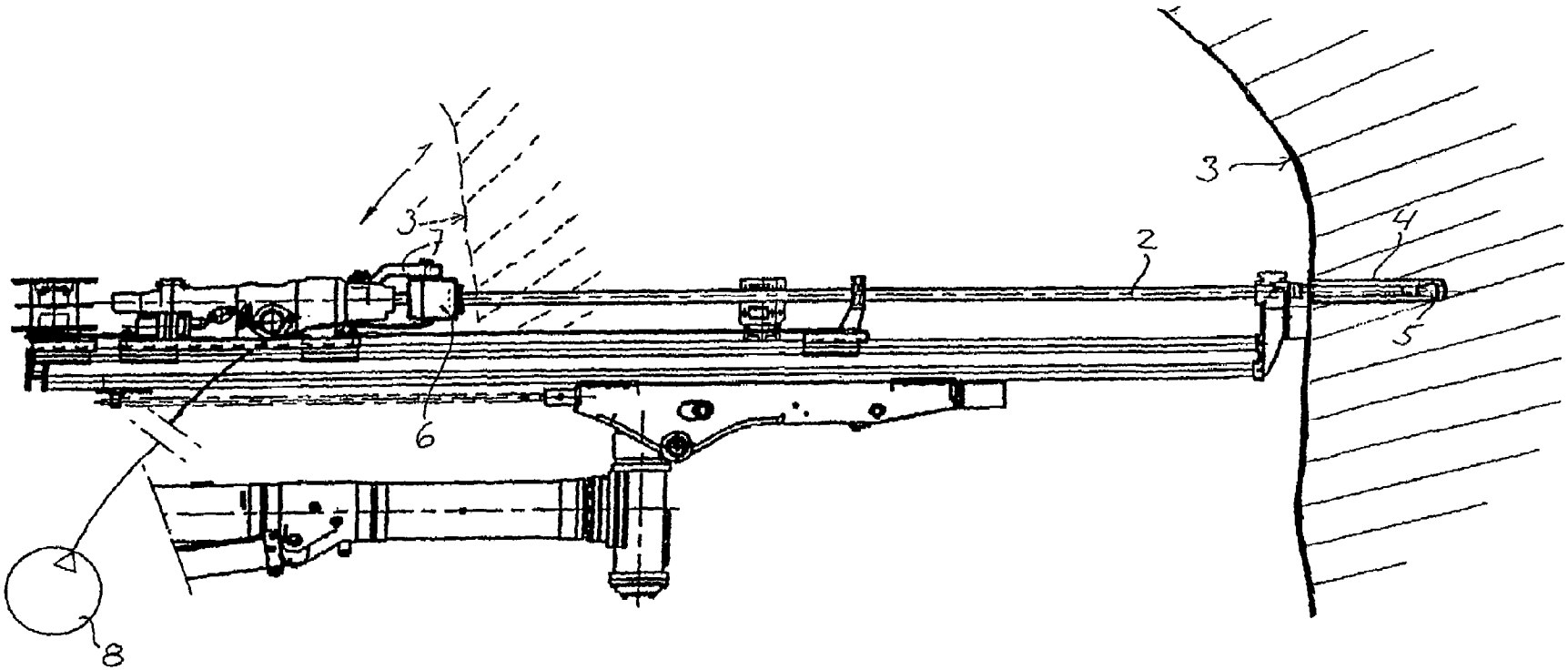
FIG. 1 diagrammatically shows a drilling machine in the process of installing a self-drilling rock bolt using a device according to the invention.

FIG. 1 shows a conventional drilling machine 1, which is movable back and forth on a slide which in turn is supported by a drilling rig (not shown). The drilling machine 1 provides rock breaking movement and energy to a self-drilling rock bolt 2, which is to be installed inside a bore hole 4 to be drilled in a rock wall or roof having a rock face 3. In particular the bore hole 4 is produced by means of a drill bit 5 positioned at the end of the self-drilling rock bolt 2.

After having completed the process of producing the bore hole for the entire rock bolt, the position of the rock face relative to the rock bolt will be as indicated with interrupted lines at 3', i.e. at the very a proximal end of the rock bolt 2.

A swiveling device 6 is rigidly attached to the drilling machine by means of a holder 7.

After having completed the drilling step the swiveling device 6 will be activated in such a way that a sealed channel will be formed between an expansion fluid source 8 and an expandable portion of the self-drilling rock bolt 2 in a manner which will be described below. This makes it possible to complete the entire installation procedure including the drilling step and the expansion step without having to remove the drilling machine from the rock bolt.

Figure 2:
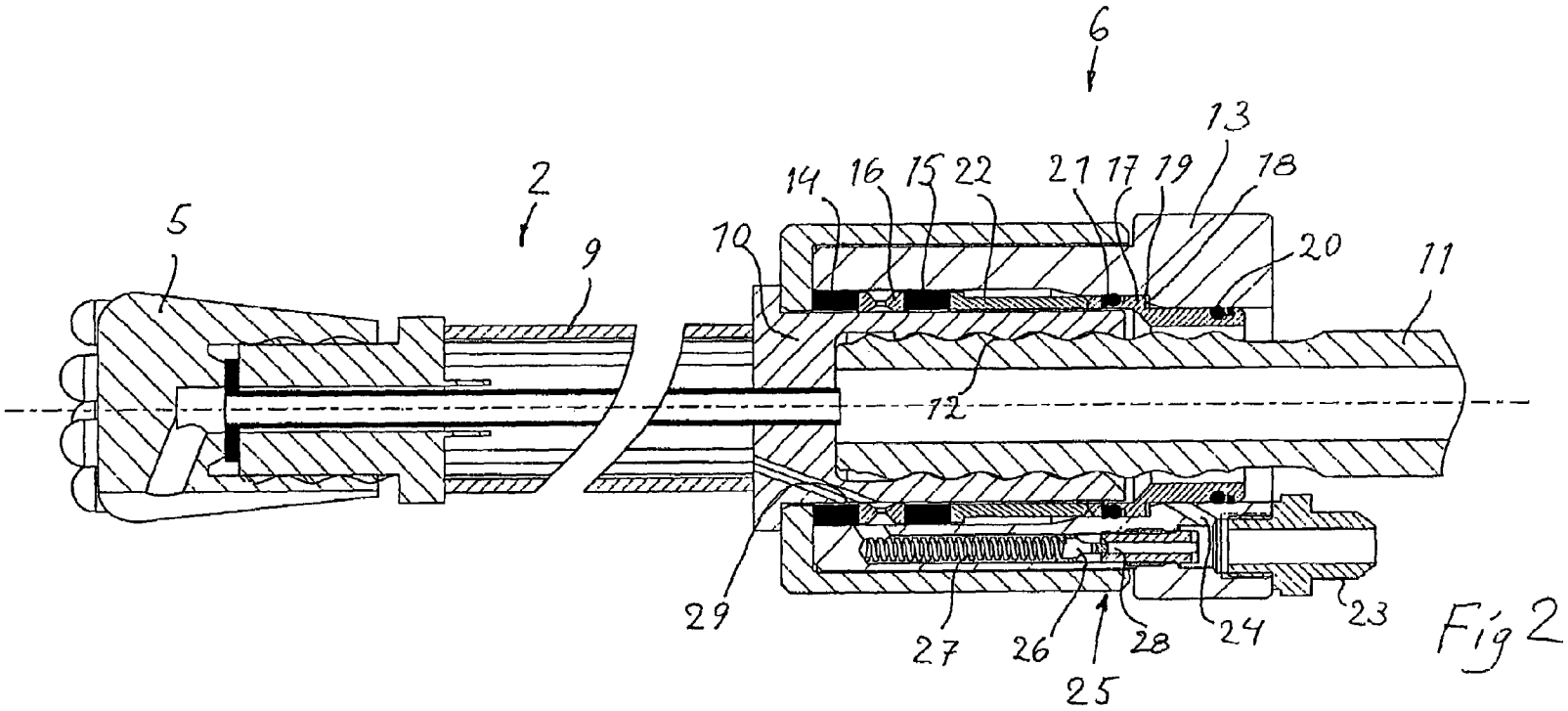
FIG. 2 shows a device according to the invention co-operating with an inventive rock bolt in an axial section.

In FIG. 2 the swiveling device 6 is shown in greater detail in co-operation with an expandable self-drilling rock bolt 2, which, as seen from its distal end, includes a drill bit portion 5 comprised by a drill bit and a drill bit holder. The drill bit holder is being attached to an expansion portion 9, which in turn at its proximal end is attached to a connecting portion 10. The connecting portion 10 is in its inside provided with threads 12 in order to be fitted to a drilling machine adapter 11 protruding from a not shown drilling machine and having the corresponding threads.

The swiveling device provides a swivel housing 13, which at one end region encloses a pair of sealing rings 14 and 15 which are separated by a distance ring 16 having one or more radial the passages for fluid. At another region inside the swivel housing 13, preferably opposite to the position of the sealing rings 14 and 15, there is arranged a piston 17 which together with a cylinder 19, being formed in the inside of the swivel housing 13, forms a working chamber 18 which is sealed with annular piston seals 20 and 21.

The piston 17, upon pressurizing the working chamber 18, moves axially to the left, as seen in the figure, and provides an axial pressure on the sealing rings 14 and 15 over a distance sleeve 22. Hereby the sealing rings 14 and 15 will be subjected to an axial pressure of a magnitude enough to make them expand radially inwards so that they will provide a safe and secure seal against the outside of a circular cylindrical surface of the connecting portion of the expandable rock bolt 2.

In the shown embodiment expansion fluid enters the swivel housing over a nipple 23 which is connected to a not shown pressure fluid source.

The nipple 23 is screwed into a space inside the swivel housing which on the one hand communicates with the working chamber 18 over a tightening fluid channel 24. On the other hand said space communicates with a pressure control valve 25, which includes a valve body 26 which is spring loaded by a helical spring 27 against a valve seat 28.

When fluid pressure in the space at the inside of the nipple 23 exceeds a predetermined limit, the pressure will force the valve body to the left at seen in FIG. 2 so as to achieve communication between said expansion fluid source (not shown) and the expansion portion 9 of the rock bolt 2.

Said limit is set in such a way that upon pressurizing the space inside the nipple 23 fluid pressure will start to enter the working chamber 18 so as to press the piston 17 in the direction to the left, as seen in FIG. 2. When this travel has been completed, the pressure inside the working chamber 18 rises as will the pressure inside said space. Hereby the same increased pressure will act on an axial surface of the valve body 26 inside the valve seat 8 so that the force from the fluid will subsequently move the valve body 26.

This will provide a possibility for expansion fluid to pass through the valve along the valve boring and from there pass in the radial direction through the opening (openings) in the distance ring 16, further through an expansion fluid inlet 29 in the connecting portion 10, through an oblique boring, which leads from the expansion fluid inlet 29 through the connecting portion 10 to the inside of the expansion portion 9.

Figure 3:
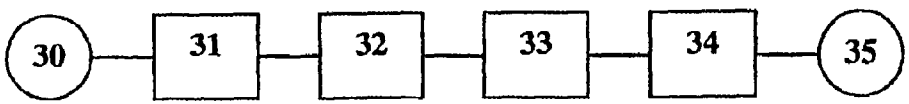
FIG. 3 is a diagram illustrating the method according to the invention.

In FIG. 3 the process of installing an inventive rock bolt is initiated at 30. 31 indicates completing the rock drilling step, 32 tightening the swivel device against the rock bolt, 33 expanding the rock bolt having the drilling machine still connected, 34 releasing the swiveling device and releasing the drilling machine and 35 terminating the installation procedure.

Figure 4:
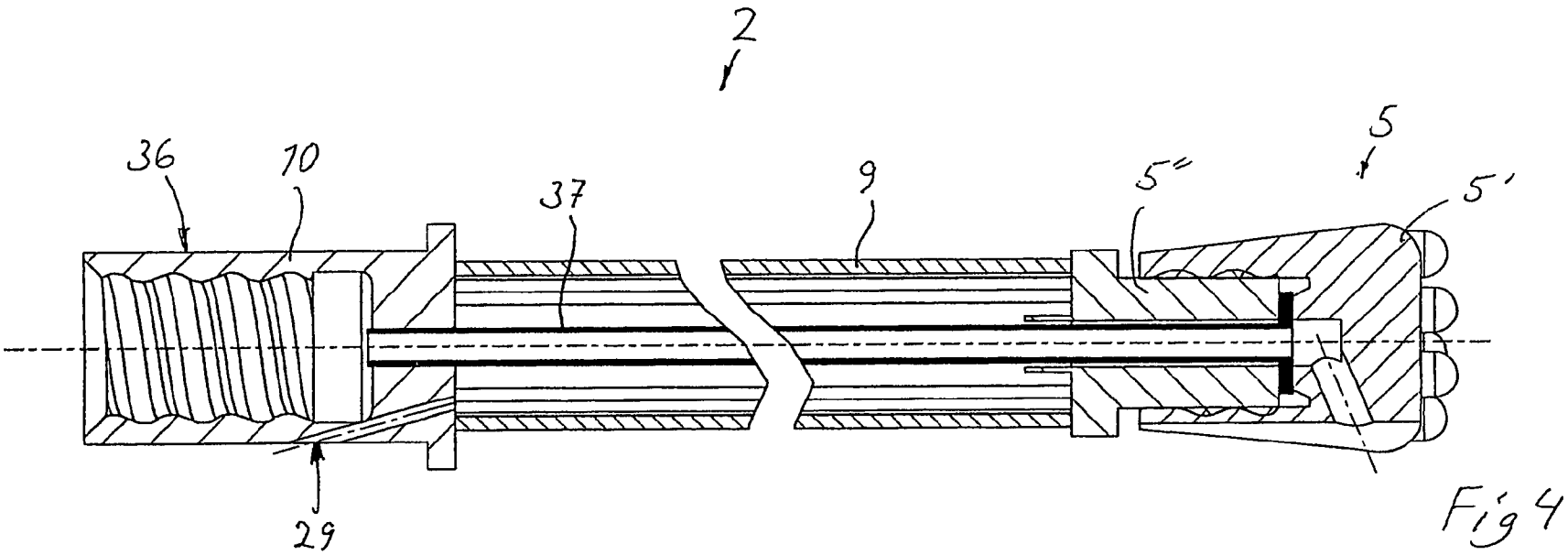
FIG. 4 is an axial section of an expandable rock bolt according to the invention.

In FIG. 4 the self-drilling expandable rock bolt 2 is shown in an axial section separate from the swiveling device so as to more clearly explain its features. At the distal end of the rock bolt there is a drill bit portion 5 being comprised of a drill bit 5' and a drill bit holder 5" having co-operating threads or other connecting means.

The expansion portion 9 functions conventionally whereas the connecting portion 10 provides a circular cylindrical surface 36 for the co-operation with the swiveling device 6 (FIG. 2) and has an expansion fluid inlet 29 communicating with the inside of the expansion portion 9.

Upon drilling, flushing fluid is as conventionally delivered from the-drilling machine and flows through a flushing fluid tube 37 arranged centrally inside the expansion portion 9 and ending at the end of the drill bit holder 5", from where flushing fluid flows through one or more outlet channels 38, so as to provide flushing at the drill bit surface.

The invention can be modified without departing from the scope of the invention. As an example the swiveling device may be constructed differently, for example such that tightening against the rock bolt is achieved through separate means, for example through a separate fluid connection to a piston corresponding to the piston 17 in FIG. 2. Also other means or motors for achieving a sealed channel may be provided.

As an example, the valve 25 opens at a pressure of about 150 bar.

The sealing arrangement may be constructed otherwise but it is preferred that sealing is achieved at two axially spaced positions which match the position of an expansion fluid inlet of the rock bolt. The connecting portion 10 of the rock bolt may be constructed and designed otherwise but it is necessary to have a surface and expansion fluid inlet (inlets), which can co-operate with the swivel device in every relative rotational position of the rock bolt and the swivel device. It is preferred that the surface 36 is circular cylindrical but other forms may also be functional, such as for example part cylindrical, cone shaped etc.

The swiveling device is preferably fastened to and supported by any conventional rock drilling machine. The support can be of any suitable kind such as any rigid steel profile which is screwed onto the drilling machine as well as to the swiveling device.

The rock bolt may also be constructed otherwise, i.a. having a more conventional construction of the interface between the connecting portion and the expansion portion. The drill bit portion 5 may be comprised of an integral unit instead of two separate parts. The expansion fluid inlet can also be arranged separate from the connecting portion, for example in a separate sleeve outside the expansion portion proximate to the connecting portion.

The invention claimed is:

1. Method for installing, in a rock wall or roof, a self-drilling expandable rock bolt (2) having a drill bit portion (5), an expansion portion (9) and a connecting portion (10), providing, in a rock breaking step, the self-drilling rock bolt (2) with a rock breaking movement and flushing fluid for producing a bore hole, and introducing, in an expansion step, pressurized expansion fluid into the expansion portion (9) in order to expand it so as to be fixed to the inside of the bore hole, characterized in introducing the expansion fluid by means of a swiveling device (6), which is arranged to co-operate with an outward surface (36) at the region of the connecting portion (10) during installation of the rock bolt, so that, in an inactive state of the swiveling device, the rock bolt (2) is free to move during the rock breaking step, and in an active state of the swiveling device, tightening it against the rock bolt (2) in the expansion step in such a way that a sealed channel for expansion fluid is established between an expansion fluid source and the expansion portion (9).

2. Method according to claim 1, wherein tightening of the swiveling device (6) against the rock bolt (2) is accomplished by pressure fluid acting on a sealing device (14, 15, 17, 18).

3. Method according to claim 2, wherein the sealing device (14, 15, 17, 18) seals on two axial sides of a rock bolt expansion fluid inlet (29).

4. Method according to claim 3, wherein expansion fluid is used for tightening.

5. Method according to claim 3, wherein tightening is accomplished by pressure fluid acting on a piston device (17).

6. Method according to claim 2, wherein expansion fluid is used for tightening.

7. Method according to claim 6, wherein tightening is accomplished by pressure fluid acting on a piston device (17).

8. Method according to claim 2, wherein tightening is accomplished by pressure fluid acting on a piston device (17).

9. Method according to claim 8, wherein the piston device (17) co-operates with a sealing device (14, 15, 17, 18) with two separated sealing rings.

10. Device for installing in a rock wall or roof a self-drilling expandable rock bolt (2) having a drill bit portion (5), an expansion portion (9) and a connecting portion (10), including means for introducing pressurized expansion fluid into the expansion portion in order to expand it so as to be fixed to the inside of the bore hole in an expansion step, characterized in that the means for introducing pressurized expansion fluid includes a swiveling device (6), which is arranged to co-operate with an outward surface (36) at the region of the connecting portion (10) during installation so that, in an inactive state of the swiveling device (6), the rock bolt (2) is free to move during a rock breaking step, and which, in an active state of the swiveling device (6), is tighten able against the rock bolt (2) in the expansion step in such a way that a sealed channel for expansion fluid is established between an expansion fluid source and the expansion portion (9).

11. Device according to claim 10, wherein the swiveling device (6) includes a sealing device (14, 15, 17, 18) for pressure fluid to act on upon tightening of the swiveling device (6).

12. Device according to claim 11, wherein the sealing device (14, 15, 17, 18) is arranged to seal on two axial sides of a rock bolt expansion fluid inlet (29).

13. Device according to claim 12 , wherein the sealing device (14, 15, 17, 18) is tighten able by means of expansion fluid.

14. Device according to claim 12, wherein a piston device (17) is acted on upon tightening.

15. Device according to claim 11, wherein the sealing device (14, 15, 17, 18) is tighten able by means of expansion fluid.

16. Device according to claim 15, wherein a piston device (17) is acted on upon tightening.

17. Device according to claim 11, wherein a piston device (17) is acted on upon tightening.

18. Device according to claim 17, wherein the piston device (17) co-operates with a sealing device (14, 15, 17, 18) with two separated sealing rings.

19. Self-drilling rock bolt (2) having a drill bit portion (5), an expansion portion (9) and a connecting portion (10), and including a flushing fluid channel (37) and an expansion fluid inlet (29), characterized in that the expansion fluid inlet (29) is positioned at a specific location on an outward surface (36) at the region of the connecting portion (10), said surface having radial and axial extensions adapted to cooperate with a swiveling device (6) in such a way that the rock bolt (2) is free to move during a rock breaking step, and that, in an expansion step, a sealed channel for expansion fluid is established between an expansion fluid source and the expansion portion (9) through the expansion fluid inlet (29) by the swiveling device (6) being tighten able against said surface of the rock bolt (2).

20. Self-drilling rock bolt according to claim 19, wherein the surface (36) is circular cylindical.

* * * * *